US005934240A

United States Patent [19]

Yokocho et al.

[11] Patent Number: 5,934,240

[45] Date of Patent: Aug. 10, 1999

[54] INTERNAL COMBUSTION ENGINE

[75] Inventors: Yoetsu Yokocho; Fujio Kobayashi, both of Tokyo, Japan

[73] Assignee: Kioritz Corporation, Tokyo, Japan

[21] Appl. No.: 08/844,252

[22] Filed: Apr. 18, 1997

[30] Foreign Application Priority Data

Apr. 24, 1996 [JP] Japan ..... 8-102666

[51] Int. Cl.[6] ..... F02F 7/00

[52] U.S. Cl. ..... 123/195 C; 123/198 E

[58] Field of Search ..... 123/195 C, 198 E, 123/41.01

[56] References Cited

U.S. PATENT DOCUMENTS

| | | | |
|---|---|---|---|
| 4,890,584 | 1/1990 | Tamba et al. | 123/41.7 |
| 5,197,426 | 3/1993 | Frangesch et al. | 123/198 E |
| 5,365,901 | 11/1994 | Kiczek | 123/195 C |
| 5,375,569 | 12/1994 | Santella | 123/195 C |
| 5,421,297 | 6/1995 | Tamba et al. | 123/41.65 |

FOREIGN PATENT DOCUMENTS 582883 9/1992 Japan .

*Primary Examiner*—John Kwon
*Attorney, Agent, or Firm*—Baker & Botts, L.L.P.

[57] ABSTRACT

An internal combustion engine which comprises an engine body, and an air-intake side protective cover disposed at an air-intake side of the engine body, wherein the air-intake side protective cover is provided on the outer surface thereof with recessed grooves. The internal combustion engine may further comprise an exhaust side protective cover which is disposed in opposite to the air-intake side protective cover with the engine body being interposed therebetween and the recessed grooves are made to have substantially the same width and interval as those of a suitable number of heat radiating slit-like through-holes formed parallel with each other in the exhaust side protective cover.

1 Claim, 4 Drawing Sheets

INTERNAL COMBUSTION ENGINE

BACKGROUND OF THE INVENTION

This invention relates to an internal combustion engine, and in particular to an internal combustion engine wherein protective covers for protecting various attachments such as an air-intake system or an exhaust system, specifically protective covers for protecting a carburetor, an air cleaner and a muffler are attached to an engine body.

Conventionally, a small air-cooled two-cycle gasoline engine (hereinafter referred to as an internal combustion engine) has been commonly employed as a power source for a portable working machine such as a bush cutter. FIG. 6 shows a schematic front view of such a conventional internal combustion engine. Referring to FIG. 6, an internal combustion engine 51 comprises a fuel tank 52 horizontally mounted at a lower portion of the internal combustion engine 51, an engine body 55 which is disposed over the fuel tank 52 and comprises a crankcase 54 and a cylinder 53 mounted integral with and perpendicular to the upper portion of the crankcase 54, a muffler 58 attached to one side of the engine body 55, and a combination of an air cleaner 57 and a carburetor 59 attached to the other side of including the cylinder 53. The outer side of each of the engine body 55, the muffler 58 and the combination of the air cleaner 57 and the carburetor 59, are covered respectively by protective covers 61, 63 and 65, which are formed of a molded thin plate designed to cover the outer appearance of each device, each protective cover being spaced apart from the surface of each device and fastened to the engine body 55.

In particular, the protective cover 65 for the muffler 58 and the protective cover 61 for both the air cleaner 57 and the carburetor 59 are arranged symmetrically about the engine body 55 so as to keep a good balance with each other in external appearance.

Additionally, the protective cover 65 for the muffler 58 is provided with many slit-like through-holes 67 for radiating heat generating from the muffler 58 itself, whereas the protective cover 61 for both the air cleaner 57 and the carburetor 59 is not provided with such through-holes water drops and the like are required to be prevented from entering into the air cleaner 57 and the carburetor 59. Thus, the protective cover 61 for both the air cleaner 57 and the carburetor 59 is formed of a flat thin plate molded into a cap-like shape having on its inner surface a plurality of stiffening ribs for the reinforcement thereof or for fastening the protective cover to the engine body 55.

Siner the stiffening ribs are concurrently formed on the inner surface of a thin protective cover at the occasion of molding the protective cover for both the air cleaner 57 and the carburetor 59 by making use of a synthetic resin, the external appearance of the protective cover is more likely to be distorted due to a thermal shrinkage in this molding process, thereby giving rise to a problem that it becomes one of the causes for producing a defective product.

A recoil handle (not shown) for a recoil starter (not shown) of the internal combustion engine is disposed near the protective cover covering both the air cleaner 57 and the carburetor 59, so that it is sometimes observed that an operator pulls the recoil handle of the recoil starter of the internal combustion engine with his one hand for starting the engine, while placing his other hand on the protective cover covering both the air cleaner 57 and the carburetor 59. In that case, the protective cover may be deformed or sometimes cracked due to the pressure of the operator's hand placed on the protective cover covering both the air cleaner 57 and the carburetor 59.

Moreover, these protective covers are constructed such that only the protective cover 65 for the muffler 58 is provided with many slit-like through-holes 67 out of all of the protective covers covering the muffler 58 or covering both the air cleaner 57 and the carburetor 59 which are arranged symmetrically about the engine body 55 as mentioned above, i.e. such through-holes 67 are not formed at all in the protective cover 61 covering both the air cleaner 57 and the carburetor 59, so that the external appearances of these protective covers are rendered unbalanced in design.

BRIEF SUMMARY OF THE INVENTION

This invention has been made under the circumstances mentioned above, and therefore an object of the present invention is to provide an internal combustion engine provided with a protective cover for both an air cleaner and a carburetor, which is improved in that a defects due to distortion resulting from the molding process of the protective cover can be overcome, in that strength of the protective cover can be improved and in that the external design of the protective cover can be improved.

Namely, according to the present invention, there is provided an internal combustion engine which comprises an engine body, and an air-intake side protective cover disposed at an air-intake side of the engine body, wherein said air-intake side protective cover is provided on the outer surface thereof with recessed grooves.

Moreover, according to the present invention, there is further provided, as a preferred embodiment, an internal combustion engine which further comprises an exhaust side protective cover which is disposed in opposite to the air-intake side protective cover with the engine body being interposed therebetween, said air-intake side protective cover being provided on the outer surface thereof with many recessed grooves having substantially the same width and interval as those of heat radiating slit-like through-holes formed parallel with each other in said exhaust side protective cover.

Since the internal combustion engine constructed as mentioned above is featured in that the air-intake side protective cover is provided on the outer surface thereof with recessed grooves, not only the strength of the protective cover is improved but also any deformation due to a heat shrinkage at the occasion of molding the air-intake side protective cover in integral with stiffening ribs to be formed on the inner surface of the air-intake side protective cover can be minimized.

Moreover, as mentioned above as a preferable embodiment, when an exhaust side protective cover is disposed in opposite to the air-intake side protective cover with the engine body being disposed therebetween, the recessed grooves are formed on the outer surface of the air-intake side protective cover in such a manner that the width and interval thereof are made substantially the same as those of a suitable number of heat radiating parallel slit-like through-holes formed in parallel with each other in the exhaust side protective cover.

DETAILED DESCRIPTION OF THE INVENTION

This invention will be further explained with reference to the drawings depicting one embodiment of this invention.

Figure 1:
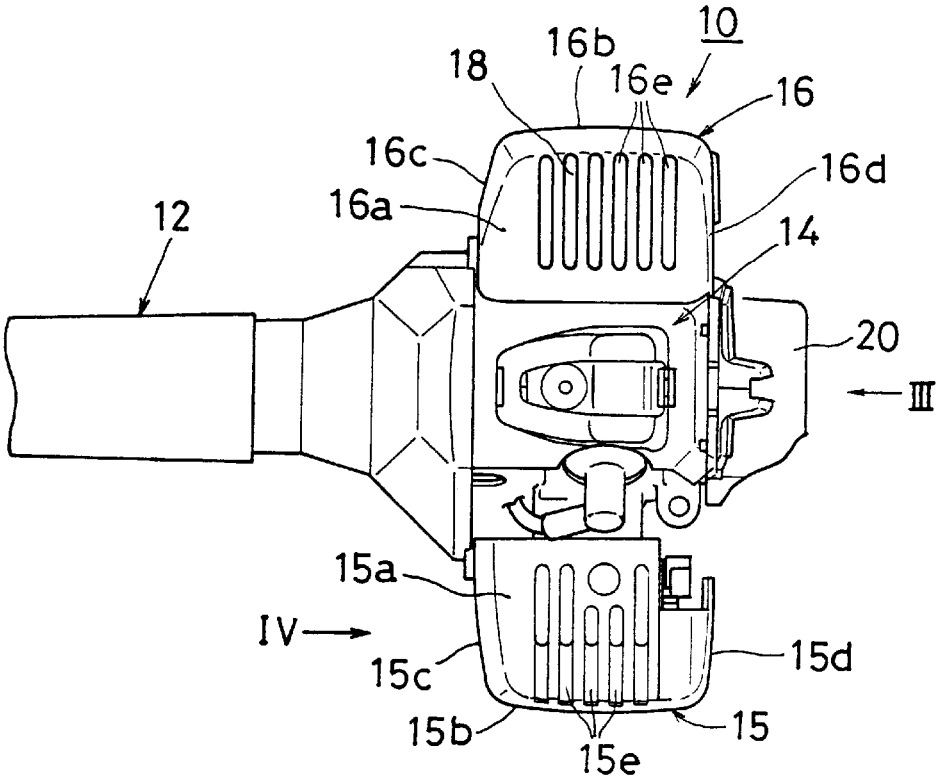
FIG. 1 is a plan view schematically showing one example of an internal combustion engine according to this invention, as it is mounted on an operating rod of a bush cutter.
Figure 2:
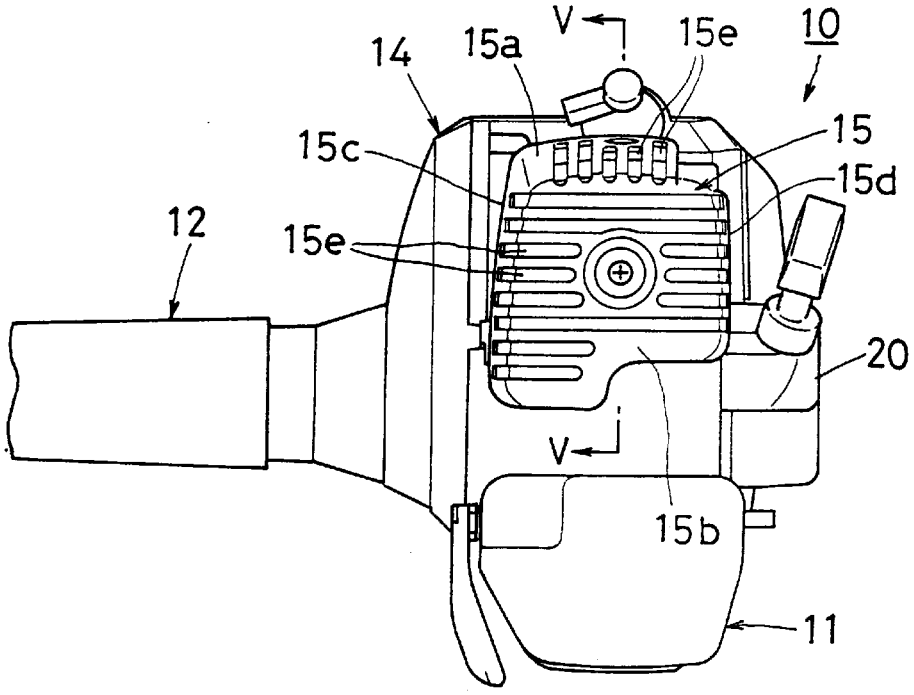
FIG. 2 is a schematic left side view of the internal combustion engine shown in FIG. 1.

FIG. 1 is a plan view schematically showing one embodiment of an internal combustion engine 10, which is mounted on one end of an operating rod 12 of a bush cutter. FIG. 2 is a schematic left side view of the internal combustion engine 10 and FIG. 3 is a front view schematically showing the internal combustion engine 10 shown in FIG. 1 as it is viewed from the direction of the arrow III.

Figure 3:
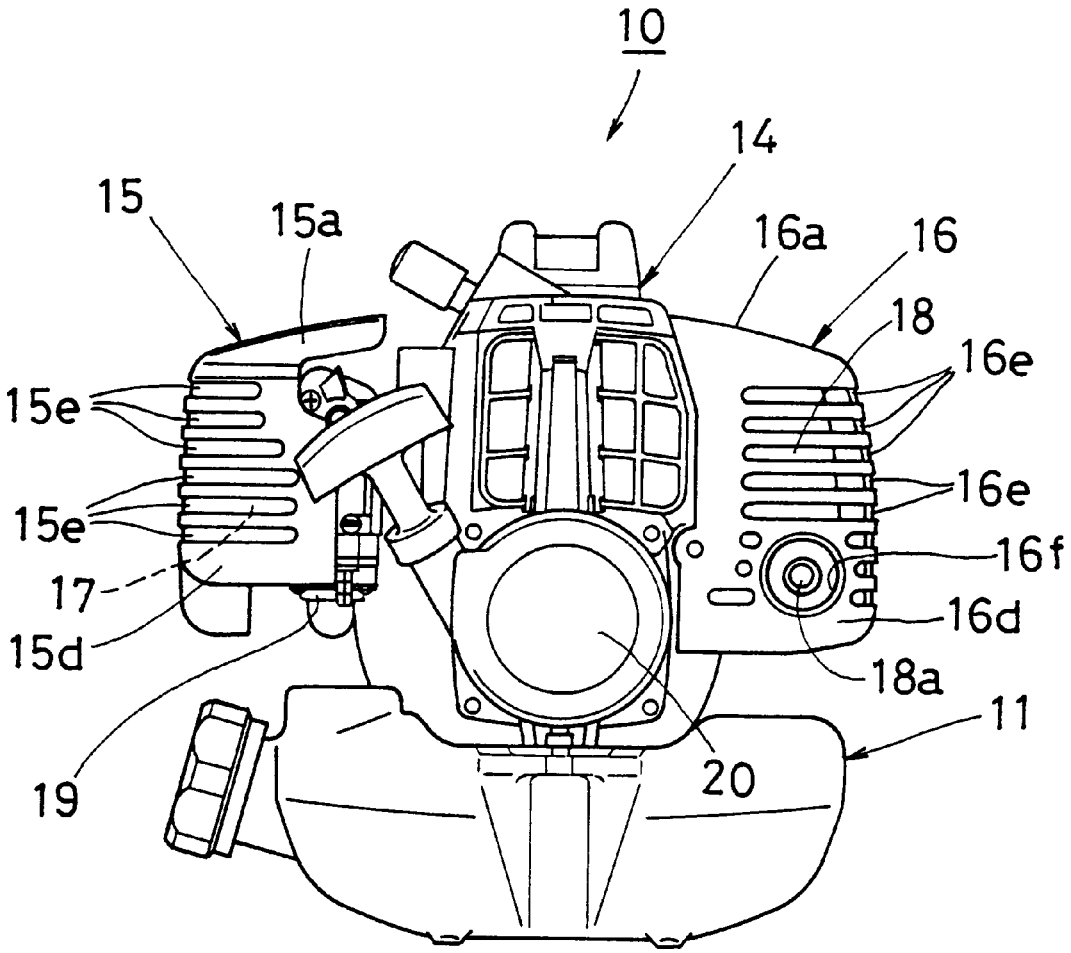
FIG. 3 is a front view schematically showing the internal combustion engine shown in FIG. 1 as it is viewed from the direction of the arrow III.

Referring to FIG. 3, the internal combustion engine 10 comprises a fuel tank 11 horizontally mounted at a lower portion of the internal combustion engine 10, and an engine body 14 which is disposed at the upper central portion of the fuel tank 11. The engine body 14 comprises, though not shown, a cylinder block and a crankcase formed at the lower end portion of the cylinder block.

A combustion chamber is formed in the cylinder block of the engine body 14. On the air-intake side (the left side in FIG. 3) of the combustion chamber are disposed air-intake attachments such as an air cleaner 17 and a carburetor 19, which are entirely covered by an air-intake side protective cover 15 which is molded in one piece with a suitable synthetic resin. On the other hand, on the exhaust side (the right side in FIG. 3) of the combustion chamber, there are disposed exhaust side attachments such as a muffler 18, which are entirely covered by an exhaust side protective cover 16 which is molded in one piece with a suitable heat resistant synthetic resin.

The air-intake side protective cover 15 and the exhaust side protective cover 16 are disposed in opposite to each other with the engine body 14 being interposed therebetween, and are fastened by suitable means to the engine body 14 or to an inner accessory.

As shown in FIG. 1, one side of the engine body 14 (left side in FIG. 1) which is angled by 90° to the sides of the engine body 14 to which the air-intake side protective cover 15 and the exhaust side protective cover 16 are fixed is fastened to the distal end of the operating rod 12 of the bush cutter. While, to the other side of the engine body 14 (right side in FIG. 1) which is opposite to the side where the operating rod 12 is fixed is attached a recoil starter 20.

The exhaust side protective cover 16 is constituted by an upper protective cover portion 16*a* and three side protective cover portions 16*b*, 16*c* and 16*d* each having a U-shaped cross-section, these upper protective cover portion 16*a* and the three side protective cover portions 16*b*, 16*c* and 16*d* being integrally molded as one piece molded body. These upper protective cover portion 16*a* and three side protective cover portions 16*b*, 16*c* and 16*d* are respectively provided with a suitable number of slit-like heat radiating through-holes 16*e* arranged parallel with each other so as to permit the heat generating from the attachments such as the muffler 18, etc. disposed inside the exhaust side protective cover 16 to be diffused to the outer atmosphere.

Reference number 16*f* in FIG. 3 denotes an outlet port which is formed in the exhaust side protective cover 16 in coaxial with a tail pipe 18*a* of the muffler 18.

Figure 4:
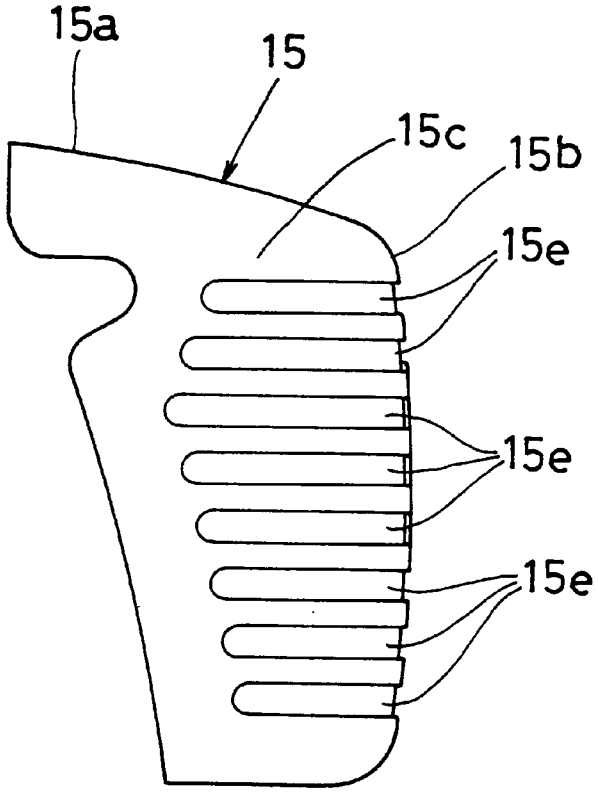
FIG. 4 is an enlarged side view schematically showing an air-intake side protective cover of the internal combustion engine shown in FIG. 1 as it is viewed from the direction of the arrow IV.
Figure 5:
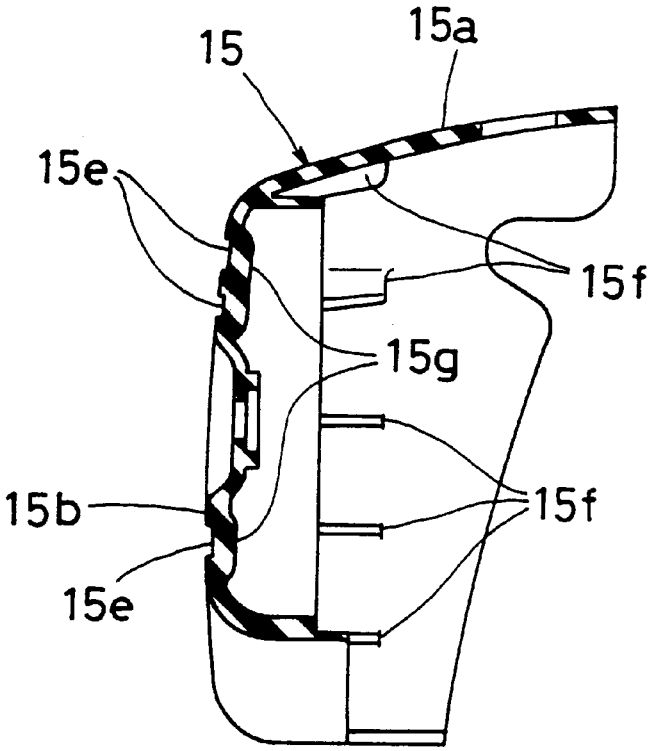
FIG. 5 is an enlarged cross-sectional view of an air-intake side protective cover of the internal combustion engine which is taken along the line V—V of FIG. 2.
Figure 6:
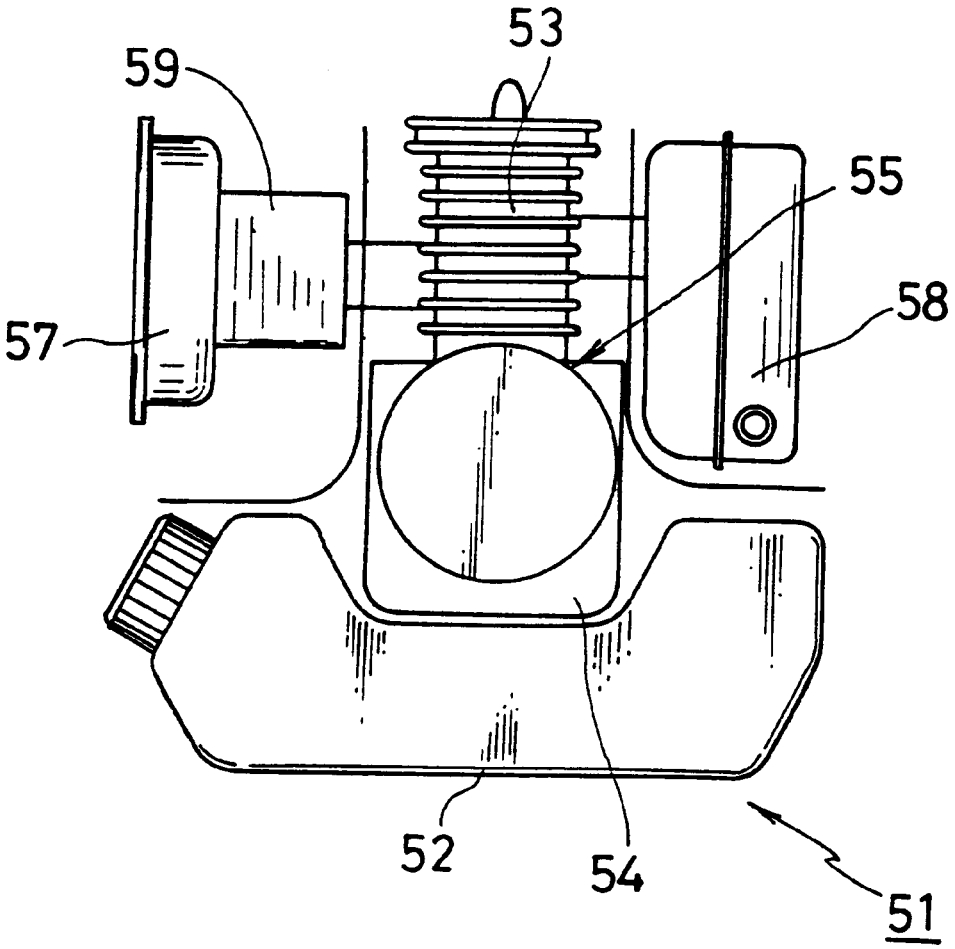
FIG.6 PRIOR ART
FIG. 6 is a front view of the conventional internal combustion engine wherein protective covers are removed.

The air-intake side protective cover 15 is constituted by an upper protective cover portion 15*a* and three side protective cover portions 15*b*, 15*c* and 15*d* each having a U-shaped cross-section, these upper protective cover portion 15*a* and the three side protective cover portions 15*b*, 15*c* and 15*d* being integrally molded as one piece molded body. As shown in FIGS. 4 and 5, these upper protective cover portion 15*a* and the three side protective cover portions 15*b*, 15*c* and 15*d* are respectively provided on the outer surface thereof with a suitable number of recessed grooves 15*e* arranged parallel with each other. The air-intake side protective cover 15 is also provided on its inner surface with a plurality of ridge-like protrusions 15*g* in conformity with the grooves 15*e* and with a suitable number of stiffening ribs 15*f* spaced apart from each other at a suitable interval. All of the recessed grooves 15*e*, the ridge-like protrusions 15*g* and the stiffening ribs 15*f* are simultaneously molded at the occasion of molding the air-intake side protective cover 15.

It is preferable in view of design to lay out the width and interval of the recessed grooves 15*e* which are formed in a suitable number and parallel with each other in such a manner that they are substantially the same as the width and interval of the slit-like radiating through-holes 16*e*, since it will render the air-intake side protective cover 15 and the exhaust side protective cover 16 which are disposed on the opposite sides of the engine body 14 well-balanced in external appearance.

It should be noted that this invention is not limited to the above embodiment but may be variously modified within the spirit described in the claims of this invention.

For example, the air-intake side protective cover is not limited to the shape shown in the drawings but may be changed variously depending on the external shape of the internal combustion engine as well as on the shapes of the attachments.

Furthermore, the width, depth, length, total number and location of the recessed groove formed on the outer surface of the air-intake side protective cover may be suitably altered.

As will be understood from the above explanations, since the internal combustion engine according to this invention is constructed such that the air-intake side protective cover is provided on the outer surface thereof with many recessed grooves, not only the strength of the protective cover is improved but also any deformation due to a heat shrinkage at the occasion of molding the air-intake side protective cover in integral with stiffening ribs to be formed on the inner surface of the air-intake side protective cover can be minimized.

Moreover, since an exhaust side protective cover is disposed in opposite to the air-intake side protective cover with the engine body being disposed therebetween and at the same time the recessed grooves are formed on the outer surface of the air-intake side protective cover in such a manner that the width and interval thereof are made substantially the same as those of the radiating parallel slit-like through-holes formed in the exhaust side protective cover, the external appearances of both protective covers are well-balanced, thus making it preferable in view of design.

We claim:

1. An internal combustion engine having an engine body with an air-intake side and an exhaust side opposite the air-intake side, the engine comprising:

an air-intake protective cover disposed over said air-intake side, said air-intake protective cover comprising an outer surface having a plurality of substantially parallel recessed grooves therein; and an exhaust side protective cover disposed over said exhaust side in substantially opposite alignment with said air-intake protective cover, said exhaust side protective cover having a plurality of heat radiating slit-like through-holes, said through-holes having a width and interval which are substantially the same as a width and interval of said recessed grooves formed on the outer surface of said air-intake side protective cover.

* * * * *

UNITED STATES PATENT AND TRADEMARK OFFICE

CERTIFICATE OF CORRECTION

PATENT NO. : 5,934,240

DATED : August 10, 1999

INVENTOR(S) : Yokocho et al.

It is certified that error appears in the above-identified patent and that said Letters Patent is hereby corrected as shown below:

Column 1, line 23, "body 55," should read -- body 55, including the cylinder 53, --;

Column 1, line 40, "through-holes water" should read -- through-holes since water --;

Column 1, line 48, "Siner" should read -- Since --.

Signed and Sealed this

Thirtieth Day of January, 2001

*Attest:*

*Attesting Officer*

Q. TODD DICKINSON

*Director of Patents and Trademarks*